United States Patent [19]

Schreiber et al.

[11] 4,111,424

[45] Sep. 5, 1978

[54] ARROW AND ARROW ATTACHMENT

[76] Inventors: Ronald E. Schreiber, 1195 Buff Way, Eugene, Oreg. 97401; La Mon D. Christensen, 5511 Barger Dr., Eugene, Oreg. 97402

[21] Appl. No.: 795,391

[22] Filed: May 9, 1977

[51] Int. Cl.[2] ..... F41B 5/02

[52] U.S. Cl. ..... 273/106.5 C

[58] Field of Search ..... 273/106.5 C, 106 B

[56] References Cited

U.S. PATENT DOCUMENTS

| | | | |
|---|---|---|---|
| D. 219,039 | 10/1970 | Jaffe et al. | 273/106.5 C X |
| D. 219,040 | 10/1970 | Jaffe et al. | 273/106.5 C X |
| 1,253,772 | 1/1918 | Bertucci | 273/106 A X |
| 2,218,593 | 10/1940 | Ushakoff | 273/106 A |
| 2,277,743 | 3/1942 | Crossman | 273/106.5 C |
| 3,337,219 | 8/1967 | Saunders | 273/106 A X |
| 3,428,321 | 2/1969 | Manning | 273/106.5 C |
| 3,614,947 | 10/1971 | Feldman | 273/106.5 C X |

OTHER PUBLICATIONS

Archery Magazine, Dec. 1970, p. 43, Sweetland Archery Products.

*Primary Examiner*—Paul E. Shapiro
*Attorney, Agent, or Firm*—James D. Givnan, Jr.

[57] ABSTRACT

Arrow construction is disclosed including an attachment having a base slidably disposed on the arrow shaft for positioning therealong during arrow flight. The attachment additionally includes outwardly projecting components acted upon by the slipstream to inhibit arrow flight. The arrow attachment is initially positioned forward of the bow to avoid damaging contact therewith and is automatically repositioned toward the arrow rearward end subsequent to arrow release.

1 Claim, 9 Drawing Figures

ARROW AND ARROW ATTACHMENT

BACKGROUND OF THE INVENTION

The present invention pertains generally to archery equipment and particularly to arrow structure providing an arrow of restricted range.

Presently known in the sport of archery are arrows provided with feathers, termed fletching, of greater surface area than conventional fletching which is provided simply for arrow stability. The purpose of such fletching having greater surface area is to inhibit arrow range thereby facilitating finding of a spend arrow. Such limited range arrows are commonly used in the hunting of small game. Flight characteristics of arrows so equipped are approximately equivalent to those of a standard arrow for the initial 70 or 80 feet of travel.

The introduction of compound bows into archery has restricted the use of such fletching by reason of the rapid depreciation thereof from the bow's multiple runs of string or wire, past which a released arrow must travel. Accordingly, arrows equipped with such fletching are largely unusable with such bows.

SUMMARY OF THE PRESENT INVENTION

The present invention is embodied within arrow structure providing enlarged fletching for purposes of aerodynamic drag to inhibit arrow range. The fletching is movably mounted on the arrow shaft from front to rear upon release of the arrow by the archer and thereby avoids damaging bow contact.

The present arrow structure includes an attachment having a base in slidable engagement with the arrow shaft permitting movement therealong immediately subsequent to arrow release. Projecting outwardly from said base are feathers or other fletching material which constitutes an aerodynamic drag on the arrow during its flight. An abutment may be disposed on the arrow shaft, adjacent to the shaft rearward end, to locate the present attachment at a desired rearward position thereby providing desired flight characteristics. The present attachment may also be used with arrows provided with conventional fletching.

Important objectives of the present arrow construction are the provision of an arrow having limited range so as to facilitate locating of a spent arrow; the provision of arrow fletching of increased surface area to provide aerodynamic drag with the attachment being slidable along the arrow shaft to avoid subjecting the fletching to passage past bow components; the provision of an arrow attachment readily combined with arrow structure in a removable manner so as to permit optional use of the attachment.

DETAILED DESCRIPTION OF THE PREFERRED EMBODIMENTS

Figure 1:
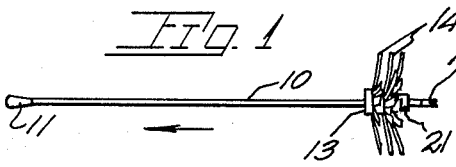
FIG. 1 is a side elevational view of an arrow on a reduced scale with the present attachment thereon and the arrow shown in flight configuration.
Figure 4:
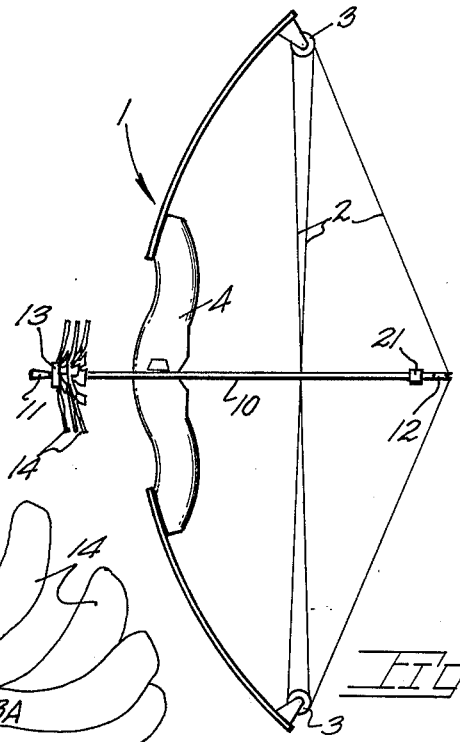
FIG. 4 is a side elevational view of a compound bow with an arrow of the present structure shown preparatory to release.

With continuing reference to the accompanying drawing wherein applied reference numerals indicate parts similarly identified in the following description, the reference numeral 1 indicates generally an archery bow which is of conventional design and shown as being of the compound type. Such bows have multiple runs of strings or wires 2 entrained about pulleys 3. A handgrip is indicated at 4.

The present arrow construction includes a shaft 10 which may be provided with a blunt point 11 of the type used for small game hunting. A nock at 12 is fitted to the rearward end of shaft 10 in the conventional manner.

Figure 2:
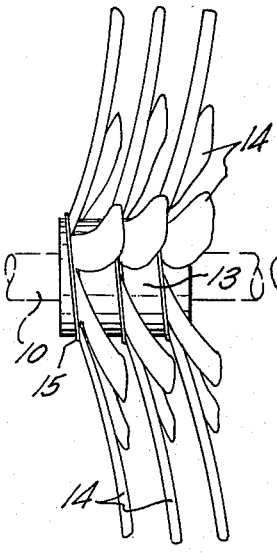
FIG. 2 is an enlarged side elevational view of the base and fletching of the present attachment.
Figure 3:
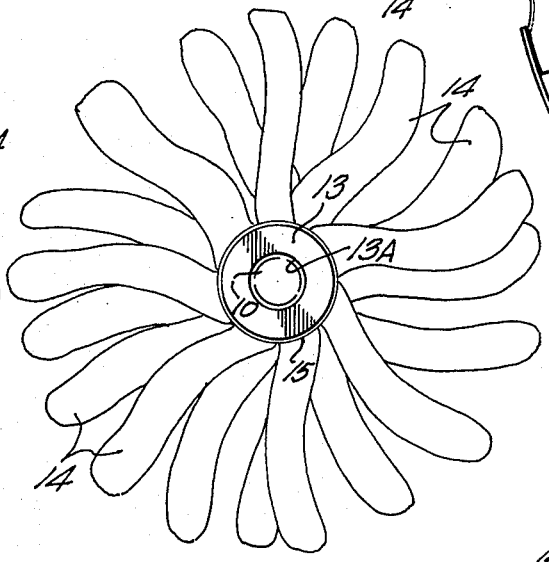
FIG. 3 is a front elevational view of FIG. 2.
Figure 5:
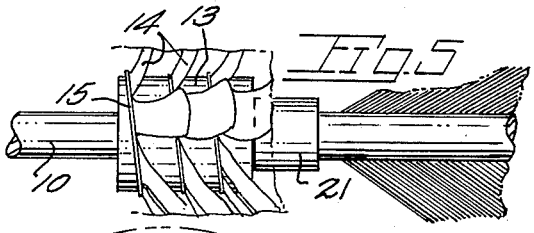
FIG. 5 is a side elevational view of the present attachment shown in a fragmentary manner in rearward abutment with a shaft mounted stop.
Figure 6:
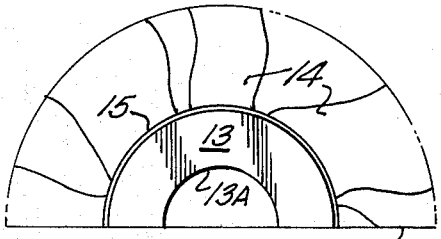
FIG. 6 is an enlarged, fragmentary frontal view of an attachment with the fletching secured to the base surface.

The present attachment includes a base 13 slidably disposed on shaft 10 by reason of a lenghtwise opening 13A within said base, with the opening being of somewhat greater cross-section than that of the arrow shaft. Base 13 may be of uniform cylindrical configuration with an outer wall surface serving to support aerodynamic means 14. Said aerodynamic means may be in the form of fletching of a continuous nature applied to base 13 in a helical manner and secured thereto by a suitable adhesive or other means. One form of fletching, as shown in FIGS. 2, 3 and 6, includes a continuous band 15 permitting convenient attachment to the base. The fletching projects outwardly from the base to provide a relatively large surface area for purposes of incurring aerodynamic drag during arrow flight. A stop 21 limits attachment travel and is forward of any conventional fletching if used.

Figure 7:
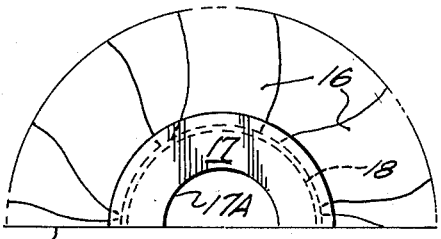
FIG. 7 is a view similar to FIG. 6 with the fletching inset within a base groove.

In FIG. 7 we show fletching at 16 inset within a groove 18 formed in a modified attachment base 17 having an opening 17A.

Base 13 may be of rigid Styrofoam or a segment of thin wall tubing.

Figure 8:
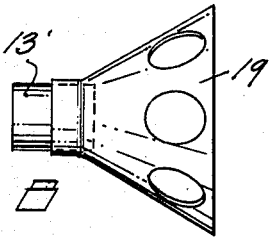
FIGS. 8 and 9 show modified aerodynamic means.
Figure 9:
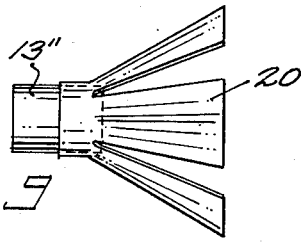

If desired, the aerodynamic means may be otherwise embodied as for example within a truncated cone or in inclined projections extending outwardly and rearwardly from the base. Modified aerodynamic means are shown in FIGS. 8 and 9 and indicated respectively at 19 and 20.

While we have shown but a few embodiments of the invention it will be apparent to those skilled in the art that the invention may be embodied still otherwise without departing from the spirit and scope of the invention claimed.

Having thus described the invention what is claimed and desired to be secured under a Letters Patent is:

1. An arrow for short range use, said arrow comprising, a shaft having fletching secured thereto adjacent the shaft rearward end, a stop in place on said shaft forward of said fletching, an attachment including a base slidably disposed on said shaft and positionable thereon from a front to a rear position against said stop during initial travel of the arrow, and said attachment having outwardly projecting aerodynamic means acted upon by the slipstream to impart drag to the arrow to inhibit arrow flight.

* * * * *